United States Patent [19]

Miyake et al.

[11] Patent Number: 4,715,548

[45] Date of Patent: Dec. 29, 1987

[54] SPINDLE DRIVE TYPE YARN WINDING APPARATUS

[75] Inventors: Yuzuru Miyake; Isao Nohara; Takami Sugioka; Susumu Onishi; Toshiyuki Ueno, all of Matsuyama, Japan

[73] Assignee: Teijin Seiki Co., Ltd., Osaka, Japan

[21] Appl. No.: 864,434

[22] Filed: May 16, 1986

[30] Foreign Application Priority Data

May 17, 1985 [JP] Japan ..... 60-105292
Jun. 24, 1985 [JP] Japan ..... 60-138399

[51] Int. Cl.[4] ..... B65H 54/02; B65H 59/00

[52] U.S. Cl. ..... 242/18 R; 242/18 A; 242/36; 242/45

[58] Field of Search ..... 242/18 R, 45, 36, 18 A, 242/49, 75.51

[56] References Cited

U.S. PATENT DOCUMENTS

| | | | |
|---|---|---|---|
| 3,536,272 | 10/1970 | Ueyama | 242/45 |
| 3,860,187 | 1/1975 | Liska et al. | 242/45 |
| 4,069,985 | 1/1978 | Lohest et al. | 242/45 |
| 4,245,794 | 1/1981 | Hasegawa et al. | 242/45 |
| 4,307,848 | 12/1981 | Barathieu | 242/18 R |
| 4,394,986 | 7/1983 | Hasegawa et al. | 242/18 R |
| 4,487,374 | 12/1984 | Sugioka et al. | 242/18 R X |
| 4,494,702 | 1/1985 | Miyake et al. | 242/18 R |
| 4,548,366 | 10/1985 | Wirz et al. | 242/18 R X |
| 4,566,642 | 1/1986 | Sommer et al. | 242/18 R |

*Primary Examiner*—Stanley N. Gilreath
*Attorney, Agent, or Firm*—Burgess, Ryan & Wayne

[57] ABSTRACT

A spindle drive type yarn winding apparatus of the bobbin changing type includes a motor for driving a bobbin holder; an inverter for supplying electric power to the motor; a contact roller for contacting with and driven by a bobbin inserted on the bobbin holder or a package wound on the bobbin; a controller for performing at least integral control action to the motor so as to control the rotating speed of the contact roller at a predetermined value; a setter which sets the winding speed, density of the wound package, stroke of the wound package and denier of the wound package, a first arithmetic circuit which calculates the diameter of the wound package; a second arithmetic circuit which calculates a gain of the controller based on winding conditions set by the setter, and diameter calculated by the first arithmetic circuit; and an altering device which alters the gain of the controller based on at least one factor set by the setter and the diameter of the wound package calculated in the first arithmetic circuit.

4 Claims, 9 Drawing Figures

| 符号 | V m/min | De | L mm | ρg/cm³ |
|---|---|---|---|---|
| a | 6000 | 800 | 250 | 1 |
| b | 6000 | 800 | 110 | 1 |
| c | 6000 | 800 | 250 | 0.5 |
| d | 6000 | 200 | 250 | 1 |
| e | 6000 | 1500 | 250 | 1 |
| f | 4000 | 800 | 250 | 1 |
| g | 2000 | 800 | 250 | 1 |

SPINDLE DRIVE TYPE YARN WINDING APPARATUS

DETAILED DESCRIPTION OF THE INVENTION

BACKGROUND OF THE INVENTION

The present invention relates to speed control of a spindle drive type yarn winding apparatus.

PRIOR ART

In a spindle drive type yarn winding apparatus, a bobbin holder has a bobbin mounted thereon and is driven by. a motor, and a contact roller is pressed against a package wound on the bobbin so that the rotating speed of the contact roller is controlled at a predetermined value. In such a spindle drive type yarn winding apparatus, a proportional, integral and derivative control action (PID control action), which is generally expressed by equation (1) below is taken place.

$$Q = \frac{d}{D}\left(K_P \times \Delta n + K_I \int \Delta n \times dt + K_D \times \frac{n}{dt}\right) \quad (1)$$

In equation (1)

Q stands for a manipulated variable;

d stands for an outer diameter of a contact roller;

D stands for an outer diameter of a package;

$K_P$ stands for a gain of proportional control action;

$K_I$ stands for a gain of integral control action;

$K_D$ stands for a gain of derivative control action; and $\frac{1}{3}$n stands for a deviation of the rotating speed of the contact roller.

In general winding apparatus, P and I control actions which take place among P, I and D control actions. Since the I control action, i.e., integral control action, of the P, I and D control actions determines a rotating speed decreasing pattern of the bobbin holder, the value of the I control action is of the most importance.

If the value of the I control action is excessively large relative to the required value, a hunting phenomenon may occur in the control system. As a result, uneveness in the tenacity of the wound yarn or uneveness in the thickness of the wound yarn may occur. In some cases, the hunting phenomenon is not damped, and vibration is caused in the rotating body. Such vibration is dangerous for the body rotating at a high speed.

Contrary to this, if the value of the I control is excessively small, the rotating speed of the bobbin holder is not decreased as the diameter of the wound package increases. Accordingly, the wound yarn includes uneven portions wbere the tenacity or the thickness of the wound yarn is deviated.

In the recent years, the number of types of yarns have increased Accordingly, it is necessary that a single winding apparatus can be used for winding various kinds of yarns which differ in their thickness over in a large range, for example, between 50 and 1500 deniers, or that a single winding apparatus can be used at various winding speeds, for example, between 3,000 and 6,000 m/minute. Further, in some cases, it is also required that the number of cops wound on a single bobbin holder can be altered by changing the traverse cam, for example, four cops with 250 mm stroke cam, six cops with 170 mm stroke or eight cops with 110 mm stroke cam.

Incidentally, the decreasing speed of the rotating speed of the bobbin holder as a lapse of winding time remarkably differs depending on the winding speeds, the thickness (denier) of the wound yarns, the length (stroke) of the wound packages, and the density of the wound packages as illustrated in FIG. 2.

In a conventional winding method, it is very difficult to previously set the gains of the control actions when the winding conditions are altered. Accordingly, it is necessary to seek the most appropriate value whenever the winding conditions, such as the kind of the wound yarn, the thickness (denier) of the wound yarn, the winding speed, or the length (stroke) of the wound package, are altered. Accordingly, it is difficult for the conventional winding apparatus to be adapted to a flexible manufacturing system.

Furthermore, the size of the modern winding apparatus is increasing, for example, the length of the bobbin holder is 1200 mm, the maximum diameter of the wound package is between 420 and 550 mm, and the ratio of the maximum diameter of the wound package and the diameter of the empty bobbin is also increased. As a result, the manipulated variable is considerably changed from the beginning of the winding operation to the completion of the winding operation. Accordingly, it is difficult to stably control the winding apparatus from the beginning of the winding operation to the completion of the winding operation.

OBJECTS OF THE INVENTION

It is an object of the present invention to provide a spindle drive type yarn winding apparatus, by which the above-described disadvantages inherent to the conventional winding apparatus can be obviated.

It is another object of the present invention to provide a spindle drive type yarn winding apparatus, which can cope with the alteration of the winding conditions, such as the kind of the wound yarn, the thickness (denier) of the wound yarn, the winding speed, or the length (stroke) of the wound package, so that the gains appropriate most for the control system of the winding apparatus can be set with ease in a short time and so that the winding apparatus can be adapted to a flexible manufacturing system.

Furthermore, it is still another object of the present invention to provide a spindle drive type yarn winding apparatus, by which stable speed control can be realized even when tbe winding speed of the apparatus is altered in a large range depending on the winding conditions, even when the ratio of the diameters between the beginning and the completion of the winding operation is large, or even when the thickness of the wound yarns is altered over a large range depending on the winding conditions.

SUMMARY OF THE INVENTION

According to the present invention, the above-described objects are achieved by a spindle drive type yarn winding apparatus comprising:

a motor for driving a bobbin holder;

an inverter for supplying electric power to the motor;

a contact roller for contacting with and driven by a bobbin inserted on the bobbin holder or a package wound on the bobbin; and a controller for performing at least integral control action to the motor so as to control the rotating speed of the contact roller at a predetermined value, characterized in that the apparatus further comprises a means which alter the gain of the integral control action of the controller as a function of at least one element selected from a group consisting of a winding speed V, a thickness De of a wound yarn, a diameter D of a wound package, a length L of the wound package, a density $\rho$ of the wound package.

Among the above-described factors, the winding speed V and the diameter D of the wound yarn package are important, and in many cases, the remaining factors, i.e., the stroke L of the wound package, the thickness De of the yarn and the density $\rho$ of the wound package, may be constant. However, if the winding apparatus is adapted to a flexible manufacturing system, the remaining factors are also of importance.

In a spindle drive type yarn winding apparatus which comprises a motor for driving a bobbin holder having a bobbin mounted thereon and a contact roller pressed against and driven by a package wound on the bobbin and which controls the contact roller at a predetermined speed, the winding speed V, the diameter D of the wound package and the number N of revolution of the bobbin holder are expressed by the following equation (2).

$$N = \frac{V}{\pi D} \tag{2}$$

Further, if the yarn is wound into a circular cylinder, while the bobbin located at the center is omitted, equation (3) is obtained.

$$\frac{\pi}{4} D^2 L \rho = \frac{De\ V}{900000} t \tag{3}$$

In equations (2) and (3),

N stands for the number of revolution of the bobbin holder (rps);

D stands for an outer diameter of a package $\pi$ stands for the ratio of the circumference of a circle to its diameter;

De stands for the thickness of the yarn (denier);

V stands for the winding speed (cm/sec);

L stands for the length of the wound package (cm);

$\rho$ stands for the density of the wound package (g/cm$^3$); and t stands for a time passed from the beginning of the winding operation (sec).

From equations (1) and (2), equation (4) is obtained.

$$N = \frac{4}{900000\ \pi^2} \times \frac{De\ V^2}{D^3 L \rho} \times t \tag{4}$$

The decreasing speed of the rotating speed of the bobbin holder can be obtained by differentiating the number of revolution N expressed by equation (4), and the decreasing speed is obtained as equation (5). In this differentiating step, the changing rates of De, V, D, L and $\rho$ are omitted since they are small in a minute time.

$$\frac{dN}{dt} = \frac{4}{900000\ \pi^2} \times \frac{De\ V^2}{D^3 L \rho} \tag{5}$$

FIG. 2 illustrates the values of dN/dt when the denier, the winding speed, the diameter of the wound package, the density of the wound package in equation (5) are changed. It is understood from FIG. 2 that the decreasing speed dN/dt of the rotating speed of the bobbin holder is remarkably changed depending on the winding conditions, such as the winding speed, the denier of the wound yarn, the stroke, i.e., the length, or the diameter of the wound package, or the density of the wound package.

The value of the integral control action in equation (1) shows the gradient of the decrease of the rotating speed of the bobbin holder during the winding operation, and in the present invention, the value of the integral control action is so set that it substantially proportional to the decreasing speed expressed dN/dt in equation (5).

BRIEF DESCRIPTION OF THE INVENTION

The present invention will now be explained in detail with reference to the accompanying drawings, wherein:

FIG. 1 is a block diagram illustrating an embodiment of the speed control according to the present invention;

FIG. 2 is a diagram illustrating the relationship between the diameter D of the wound package and the decreasing speed dN/dt of the rotating speed of the bobbin holder, when the winding speed V, the denier De, the stroke of the wound package and the density of the wound package are changed, from which it is understood that the decreasing speed dN/dt of the rotating speed of the bobbin holder is remarkably changed depending on the winding conditions, such as the winding speed, the denier of the wound yarn, the stroke, i.e., the length, or the diameter of the wound package, or the density of the wound package;

DETAILED DESCRIPTION OF THE INVENTION

PREFERRED EMBODIMENT

Figure 1:
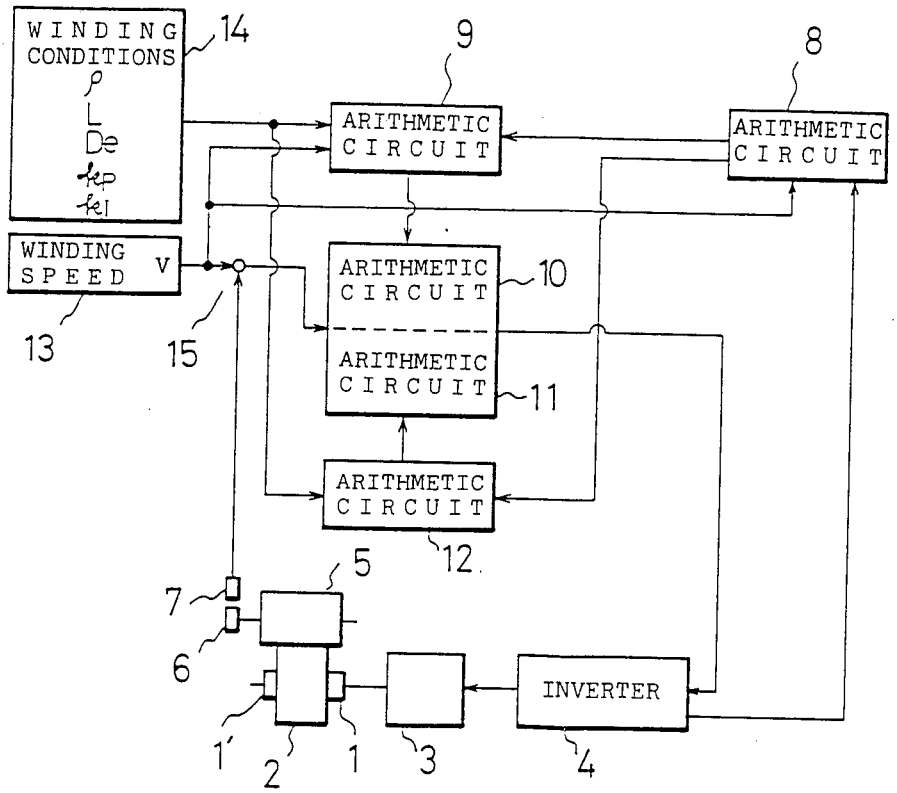

In FIG. 1, a bobbin 1' is inserted onto a bobbin holder 1, and a package 2 is wound onto the bobbin 1'.

A motor 3 is connected to the bobbin holder 1 so that the bobbin holder 1 is driven by the motor 3. The motor may be a synchronous motor or an induction motor, and in the present invention an induction motor is used.

An inverter 4 is connected to the motor 3 so that the rotating speed of the motor 3 is altered by the inverter 4.

A contact roller 5 is pressed to the package 2 and driven thereby. The contact roller 5 has a gear 6 fixed at one end thereof, and the teeth of the gear 6 are detected by the detector 7 so as to detect the rotating speed of the package 2.

An arithmetic circuit 8 calculates the diameter D of the wound package 2 from the output frequency of the inverter 4 and the value V of the winding speed set by a setter 13 for setting the winding speed.

In the setter 14 for setting the winding condition, the density $\rho$ of the wound package, the stroke (length) L of the wound package, the denier De of the wound yarn, the integral and proportional constants $k_I$ and $k_P$ are set.

An arithmetic circuit 9 calculates the gain of the integral control action from the output of the arithmetic circuit 8, the values of density $\rho$ of the wound package, the stroke (length) L of the wound package, the denier De of the wound yarn, the integral constant $k_I$ and the proportional constant $k_P$ set in the setter 14, and the winding speed V.

A comparator 15 compares the winding speed set by the winding speed setter 13 with the feed-back signal detected by the detector 7 and calculates a deviation therebetween.

An arithmetic circuit 10 performs integral calculation based on the deviation calculated at the comparator 15 and the value calculated at the arithmetic circuit 9 for calculating gain.

An arithmetic circuit 11 performs proportional calculation based on the deviation calculated at the comparator 15 and the value calculated at an arithmetic circuit 12 for calculating gain.

The arithmetic circuit 12 calculates the gain for the proportional control action based on the the output of the arithmetic circuit 8 and the value $k_P$ set in the setter.

Operation

The operation of the apparatus having the above-described construction will now be explained.

A yarn is traversed to and fro by means of a traversed device (not shown) and is wound onto the bobbin 1' inserted onto the bobbin holder 1 to form the package 2. The contact roller 5 is pressed to the package 2 and is rotated thereby. The rotating speed of the contact roller 5 is sampled by means of a detector 7, which is an electro-magnetic pickup in the present embodiment.

The value set at the setter 13 for setting the winding speed is compared with the feed-back signal detected by the detector 7 in the comparator 15, and a deviation $\Delta n$ is calculated.

The diameter D of the wound package is calculated from the frequency of the inverter 4 and the winding speed set by the winding speed setter 13.

In the arithmetic circuit 9, the value of dN/dt, i.e., the gain of the integral control action, is calculated based on equation (5) from the denier De of the wound yarn, the stroke (length) L of the wound package, the density $\rho$ of the wound package, and the integral constant $k_I$, which are set in the setter 14 for setting the winding condition, and the winding speed V and the ratio d/D between the diameter of the contact roller 5 and the diameter D of the wound package, which are set in the winding speed setter 13. Further, integral calculating is performed in the arithmetic circuit 10 based on the deviation $\Delta n$ calculated at the comparator 15 and the value dN/dt calculated at the arithmetic circuit 9 for calculating gain.

The ratio d/D is multipled with the proportional terms and the integral terms as a kind of gain which reflects the deviation of the detected rotating speed of the contact roller taking into consideration the relationship between the deviation of the rotating speed of the contact roller and the deviation of the rotating speed of the bobbin holder. The d/D may be multiplied with the sum obtained by adding the proportional term and the integral term. In another method, after d/D is multiplied with the deviation $\Delta n$ obtained in the comparator, the output may be input to the proportional term and the integral term. In the present embodiment, after d/D is multiplied with $k_P$ and $k_I$ in the arithmetic circuits 9 and 12, the obtained result is processed.

The proportional control action is required to instantaneously respond to the variation in the speed so as to remedy the variation in the speed caused by the disturbance during the winding operation, such as ribboning formed on the package or fluctuation of the speed caused by the change of the pressing force of the contact roller. Accordingly, in the present embodiment, the gain of the proportional control action is set to be proportional to the moment of inertia $GD^2$ of the wound package. More specifically, the diameter D of the wound package is calculated, and then the gain of the proportional control action is calculated in the arithmetic circuit 12 based on the value of $D^4$ ($GD^2$ is proportional to $D^4$) and the constant $k_P$ set by the setter 14, and the proportional calculation is performed in the arithmetic circuit 11 based on the deviation $\Delta n$ calculated in the comparator 15.

The value for the proportional control action may be constant, if it is desired.

Since the desired control performance can be achieved by the integral and proportional control action, the derivative control action is omitted in the present embodiment.

The above-explained integral and proportional control action of the present embodiment is expressed by equation (6).

$$Q = \frac{d}{D}\left(k_P \times K_P \times \Delta n + k_I \times K_I \times \int \Delta n \, dt\right) \tag{6}$$

In equation (6),

Q stands for the manipulated variable to the inverter;

$$K_I = \frac{dN}{dt}$$

$k_P$ stands for the constant for adjusting the manipulated variable depending on the characteristic of the motor;

$k_I$ stands for tbe constant for adjusting the manipulated variable depending on the characteristic of the motor; and $\Delta n$ stand for the deviation.

The value of $k_P$ and $k_I$ determines the ratio of the manipulated variables and the variation, which depend on the characteristic of the motor. After a certain value of $k_P$ and $k_I$ has been experimentally determined at a point where the control ability is stable under a certain level of condition, a stable speed control can be performed if the winding speed, the stroke of the wound package, the density of the package, the denier of the wound yarn are input.

In the present embodiment, the same value of $k_P$ and $k_I$ is used for both the increase and decrease. However, different values of $k_P$ and $k_I$ may be used for the increase and decrease by discriminating the sign of the deviation $\Delta n$.

It is preferred that a small value of $k_P$ is selected when it is used to increase the rotating speed of an induction motor and that a large value of $k_P$ is selected when it is used to decrease the rotating speed of the induction motor, because induction motors have non-operating zone caused by slip of the motors.

The integral control action determines a rotating speed decreasing pattern of the bobbin holder. Since the bobbin holder of a winding apparatus is always decreased during the winding operation, it is preferred that the value of $k_I$ is set large in a decreasing direction and that the value of $k_I$ is set small in an increasing direction.

Although in the above-explained embodiment, the denier De, the stroke L and the density $\rho$ are input, the conditions may be input from a memorizing circuit where various conditions have been previously memorized.

The value of dN/dt is not required to exactly satisfy the above-described equation (5) as long as it is obtained from a formula similar to equation (5).

The present invention is also applicable to a winding apparatus of tension control type.

It is preferred that the motor has such a large capacity that its rotating speed can be altered at a gradient which is equal to or more than that of twice of dN/dt.

In the above-described embodiment, digital control is applied, however, analog control may be applied.

ADVANTAGES OF THE INVENTION

According to the present invention, since the manipulated variable for the integral control action is proportional to the decreasing gradient of the rotating speed of the bobbin holder, the speed control as winding up of the package can be stable, and uneveness in the tenacity and the thickness of the wound yarn due to hunting phenomenon can be prevented from occurring. Further, vibration of the rotating body caused by the hunting can also be prevented from occurring.

Further according to the present invention, the yarn winding apparatus can cope with the alteration of the winding conditions, such as the stroke of the wound package, the thickness (denier) of the wound yarn, the kind of the wound yarn, or the winding speed, and stable control ability can be achieved. Accordingly, the winding apparatus can be adapted to a flexible manufacturing system.

Furthermore, according to the present invention, since the manipulated variable for the integral control action is changed depending on the winding speed, the diameter of the wound package, or the denier of the wound yarn, stable speed control can be realized even when the winding speed of the apparatus is altered in a large range, even when the ratio of the diameters between the beginning and the completion of the winding operation is large, or even when the thickness of the wound yarns is altered in a large range depending on the winding conditions.

According to the present invention. the gains of the controller can be selected at appropriate values, and sudden variation of the rotating speed, such as hunting, does not occur in the rotating speed of the bobbin holder. Accordingly, the capacity of the inverter can be minimized.

ANOTHER EMBODIMENT

Another embodiment of the present invention will now be explained. In this embodiment, a spindle drive type yarn winding apparatus is of bobbin changing type, wherein a plurality of bobbin holders having bobbins mounted thereon are driven by a plurality of drive motors, respectively, via an inverter, and a yarn which has been wound onto the bobbin inserted onto one of the bobbin holders is transferred to the bobbin inserted onto one of the other bobbin holders when the amount of the wound yarn reaches a predetermined value.

In a conventional yarn winding apparatus of bobbin changing type, a plurality of bobbin holders are connected to inverters, respectively, so that tension in the wound yarn or the peripheral speed of the package is controlled at a predetermined value.

Such a conventional yarn winding apparatus has following disadvantages.

Figure 7:
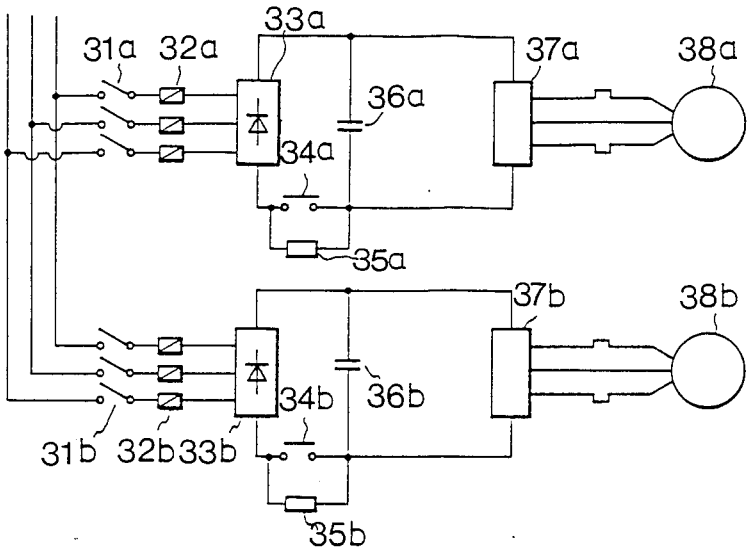
FIG. 7 is a circuit diagram of a conventional inverter.
Figure 8:
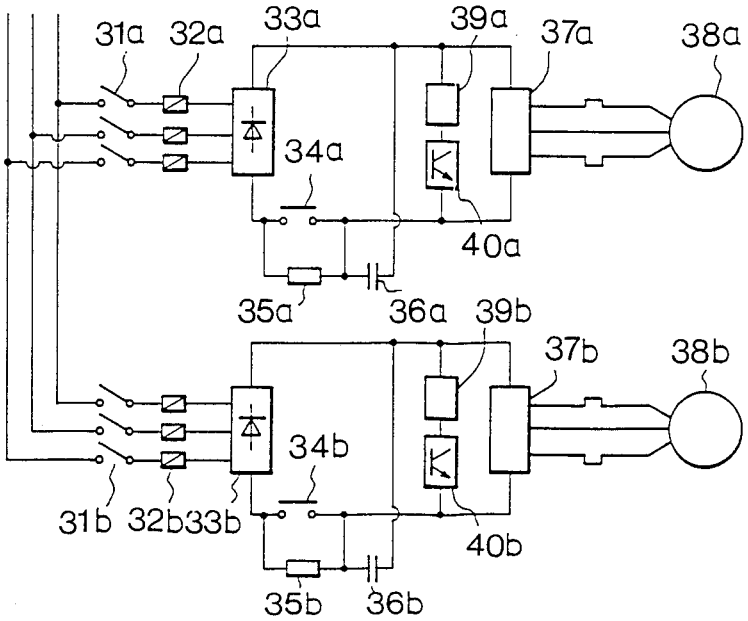
FIG. 8 is a circuit diagram of a conventional inverter, provided with a regenerative braking function and a function for compensating temporary power suspension.

(1) Since motors driving a plurality of bobbin holders need inverters, respectively, the space for installing the inverters is large, and the cost for the inverters is expensive. More specifically, as shown in FIGS. 7 and 8, two inverters, each of which has a capacity of C, are necessary.

(2) Since the plurality of inverters require condensers, respectively, in order to compensate temporary power suspension, the space for installing the condensers is large, and the cost for the condensers is expensive. More specifically, as shown in FIG. 8, two condensers are necessary to compensate electric current C.

(3) Since the plurality of inverters require regenerative resistance, respectively, if the drive motors are regeneratively braked via the inverters, the space for installing the regenerative resistances is large, and the cost for the regenerative resistances is expensive.

In order to obviate the above-described disadvantages, when the present invention is applied to such a yarn winding apparatus of bobbin changing type, it is recommended that the winding apparatus is constructed as follows.

The winding apparatus is characterized in that:

a plurality of drive motors are connected to a plurality of bobbin holders, respectively;

the drive motors are connected to a inverter which comprises a plurality of inverter sections and a converter section;

the plurality of inverter sections are disposed in parallel with each other and are connected to the plurality of drive motors, respectively;

the converter section is common to the plurality of inverter sections; and the capacity of the converter section is set at at least the sum of the maximum load of one of the plurality of bobbin holders under ordinary winding conditions and a load of another one of the plurality of bobbin holders upon start of winding operation under ordinary winding conditions.

In this case, a condenser for compensating temporary power suspension or a regenerative resistance is connected to the plurality of inverter sections in common.

Figure 9:
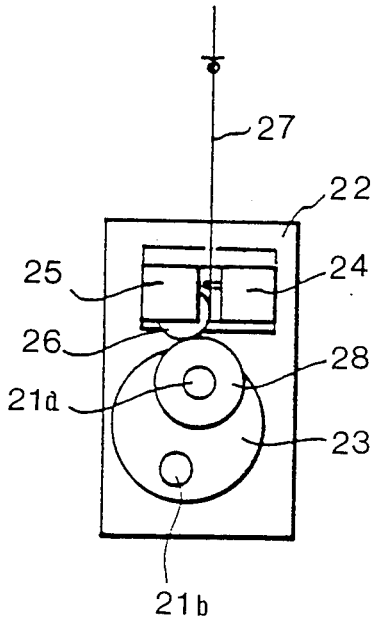
FIG. 9 is an elevation view of a yarn winding apparatus of automatic bobbin changing type according to the present invention.

FIG. 9 is an elevation view of a turret type automatic bobbin changing yarn winding apparatus of peripheral speed control type. A machine frame 22 has a turret table 23 turnably mounted thereon, which has two bobbin holders 21*a* and 21*b* rotatably mounted thereon. The bobbin holders 21*a*and 21*b* are connected to drive motors 38*a* and 38*b* (see FIGS. 3 and 4), respectively, and are driven at a pred-etermined speed.

A traverse device 24 is provided with a traverse guide (not shown), which traverses a yarn 27 to and fro. A contact roller frame 25 has a contact roller 26 rotatably mounted thereon, which is in contact with a bobbin inserted onto the bobbin holder 21*a* or 21*b* or a yarn package 28 formed on the bobbin and is driven thereby so as to measure the peripheral speed of the package 28. The traverse device 24 and the contact roller frame 25 are vertically movable relative to the turret table 23.

In a conventional yarn winding apparatus of automatic bobbin changing type, as illustrated in FIG. 7, inverters, comprising converter sections 33*a* and 33*b* and inverter sections 37*a* and 37*b*, respectively, are connected to the drive motors 38*a* and 38*b*, respectively. Relays 31*a* and 31*b* switch the supply of power and are connected in series to fuses 32*a* and 32*b*, respectively. Contacts of relays 34*a* and 34*b* are closed after the relay 31*a* and 31*b* are switched on so that the resistances 35*a* and 35*b* resist rush current upon switching on the relays 34*a* and 34*b*.

In the conventional yarn winding apparatus of automatic bobbin changing type, the inverters are installed for the respective drive motors. Accordingly, the space for the winding apparatus is large. Further, each of the inverters has a large enough capacity to be durable against the maximum load under the normal winding operation, and is expensive.

Furthermore, in another conventional yarn winding apparatus of automatic bobbin changing type, as illustrated in FIG. 8, transistors 40*a* and 40*b* or the like, which perform switching operation upon detecting the regenerative energies, and regenerative resistances 39*a* and 39*b* are required to be connected to the inverters, respectively, in order to compensate the regenerative energies generated upon braking the drive motors 38*a* and 38*b*. Accordingly, the winding apparatus need a large space for installation and is expensive.

In addition, the inverters need condensers 36*a* and 36*b* which compensate temporary power suspension for several seconds upon occurrence thereof and over load upon stating of the drive motors or the like. Accordingly, the winding apparatus need a large space for installation and is expensive.

Figure 5:
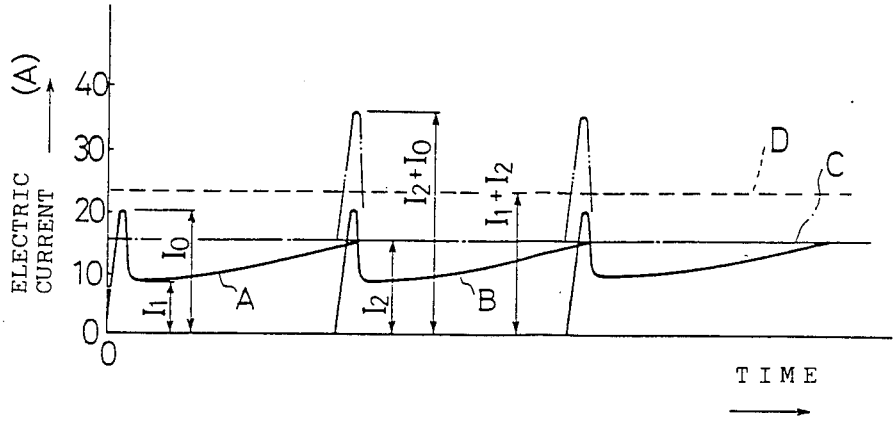
FIG. 5 is a diagram illustrating an electric current when a bobbin holder in a yarn winding apparatus of automatic bobbin changing type is driven by a motor.
Figure 6:
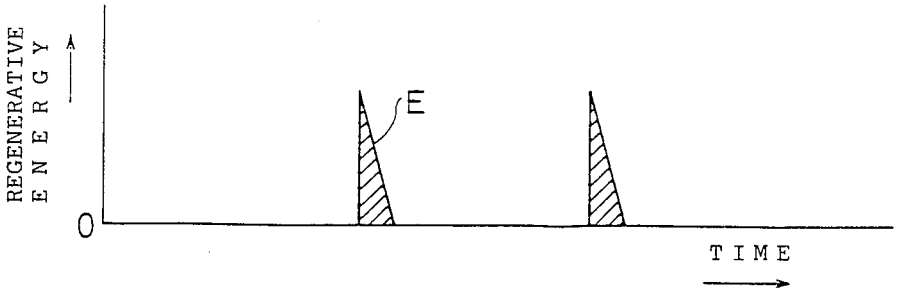
FIG. 6 is a diagram illustrating a regenerative energy when a bobbin holder in a yarn winding apparatus of automatic bobbin changing type is regeneratively braked by a motor used for driving the bobbin holder.

The load characteristic of a spindle drive type yarn winding apparatus of bobbin changing type is illustrated in FIG. 5. When the drive motor 38*a*, which is connected to the bobbin holder 21*a*, is focussed on, starting current $I_0$ flows for a short time, and then, normal winding condition is achieved. At the beginning of the normal winding condition, since the package 28 formed on the bobbin inserted on the bobbin holder 21*a* is small, the electric current $I_1$ at the beginning of the winding operation is small. As the wound amount of tbe package 28 formed on the bobbin inserted onto the bobbin holder 21*a* is increased, the electric current for driving the drive motor 38*a* increases along a curve A, and reaches the maximum current $I_2$ when the diameter of the package 28 becomes a predetermined amount.

At the completion of the winding operation, the other drive motor 38*b* is started. When the rotating speed of the other bobbin holder 21*b* reaches a predetermined speed, the yarn, which has been wound onto the bobbin inserted onto the bobbin holder 21*a*, is transferred to the other bobbin inserted onto the bobbin holder 21*b*, and winding operation is continued. The drive motor 38*b* has a load characteristic B similar to the load characteristic A.

In the conventional yarn winding apparatus of bobbin changing type, drive motors 38*a* and 38*b* are connected to the inverter, respectively, and each inverter has such a capacity, which is designated by C in FIG. 5, that it can supply power to the drive motor 38*a* or 38*b*. Although the capacity of one inverter is small, the whole winding apparatus requires a capacity of 2C, since the winding apparatus has two inverters installed therein.

The present inventors focussed on the characteristic feature of the yarn winding apparatus of bobbin changing type that when the current $I_2$ supplied to one drive motor 38*a* or 38*b* is maximum upon completion of winding operation on one bobbin holder 21*a* or 21*b* connected to the drive motor, the current $I_1$ supplied to the other drive motor 38*b* or 38*a* is minimum because the winding operation is just begun onto the bobbin holder 21*b* or 21*a*. Further, they also found that, accordingly, the capacity D of the inverter installed in the yarn winding apparatus of bobbin changing type can be remarkably lessen relative to the capacity 2C required for the conventional apparatus. In addition, they also found that the space for installing the winding apparatus can be decreased if parts, which can be used for both the drive motors 38*a* and 38*b*, are disposed in common to both the drive motors 38*a* and 38*b*.

Figure 3:
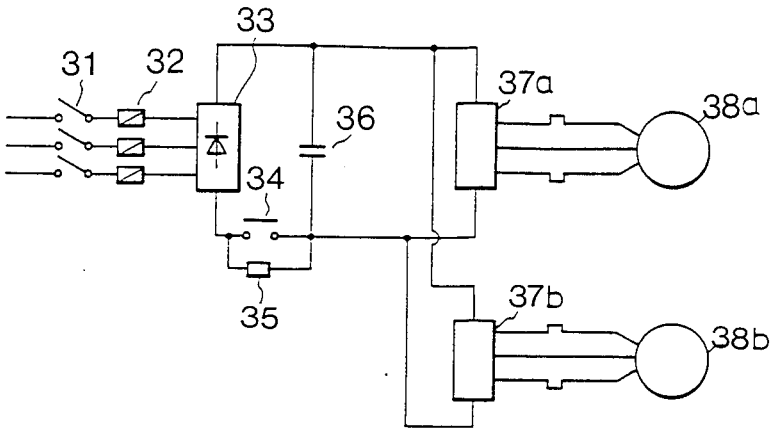
FIG. 3 is a circuit diagram of an inverter of a yarn winding apparatus of bobbin changing type according to the present invention.
Figure 4:
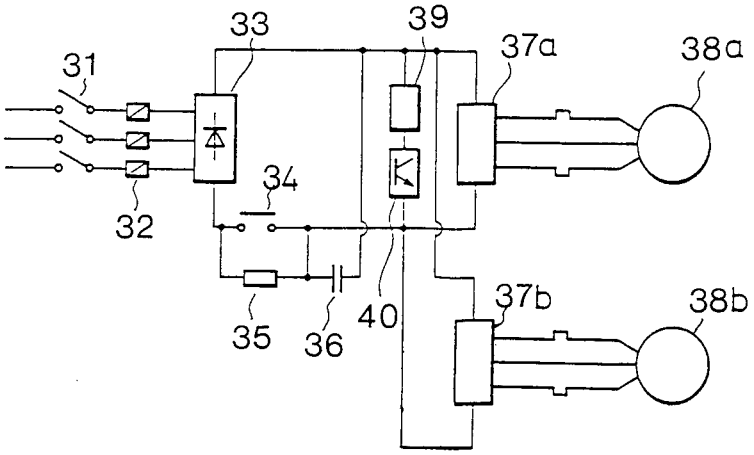
FIG. 4 is a circuit diagram of an inverter, provided with a regenerative braking function and a function for compensating temporary power suspension, of a yarn winding apparatus of bobbin changing type according to the present invention.

In the present invention, as illustrated in FIG. 3, inverter sections 37*a* and 37*b* of the inverter are disposed in parallel with each other and are connected to the drive motors 38*a* and 38*b*, respectively. Contrary to this, a converter section (a direct current section) 33 is common to the drive motors 38*a* and 38*b*.

The capacity Z of the converter section 33 is set at least to the amount $I_1+I_2$, which is the sum of the maximum load $I_2$ of one of the bobbin holders 21*a* and 21*b* under ordinary winding conditions and a load $I_1$ of another one of the plurality bobbin holders 21*b* and 21*a* upon start of winding operation under ordinary winding conditions.

The capacity Z of the converter section 33 is smaller than $2I_2$, which is required by a conventional winding apparatus.

In short, the capacity satisfies the following conditions.

$$I_1+I_2 \leqq Z < 2I_2$$

Any conventionally known inverters, such as inverters using transistors or thyristors as the inverter sections, may be used. A condenser 36 for compensating temporary power suspension and a regenerative resistance 39 are connected to the plurality of inverter sections 37*a* and 37*b* in common.

Figure 2:
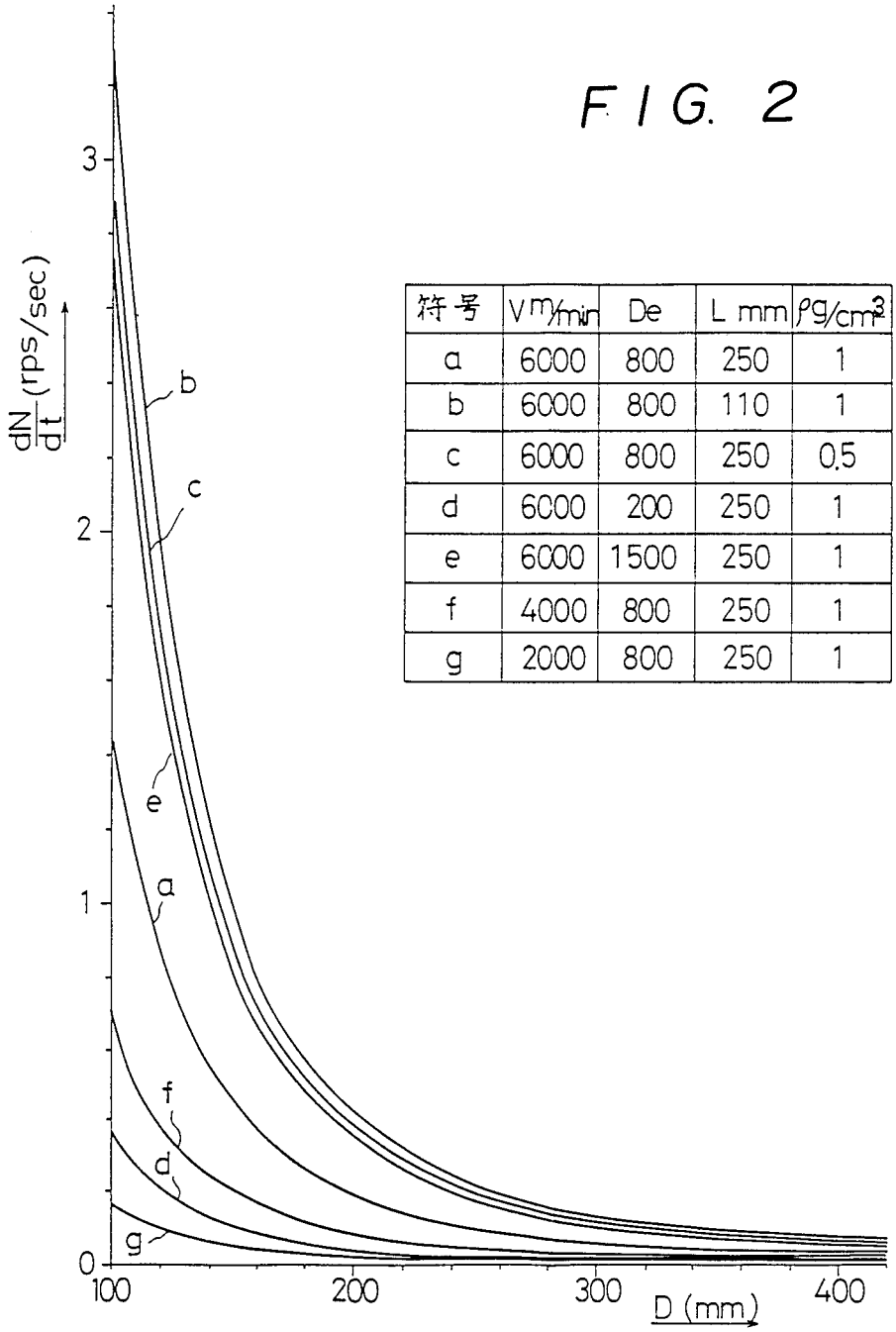

In FIG. 3, while the relay 31 is closed, the contact roller 26 is pressed to the package 28 wound onto the bobbin holder 21*a*, which is driven by the drive motor 38*a*. The rotating speed of the contact roller 26 is detected, and the proportional and integral control action, which has been explained in detail referring to FIGS. 1 and 2, is performed by means of a controller so that the rotational speed of the contact roller is controlled at a predetermined speed.

More specifically, the converter section 33 of the inverter converts alternating current into direct current, and the inverter section 37*a* is controlled by the controller (not shown) and inverts the direct current into alternating current having a desired frequency, which is supplied to the drive motor 38a to drive the motor 38a along the curve A illustrated in FIG. 5.

When the wound amount of the package 28 reaches a predetermined amount, the other motor 38b is started, and the inverter section 37b is controlled. When the bobbin holder 21b, which has been at a stand-by position, reaches a predetermined speed, the turret table 23 is turned, and the yarn 27 is transferred from the full package 28 formed on the bobbin holder 21a to a bobbin inserted onto the other bobbin holder 21b by way of a conventionally known method.

Thereafter, the rotating speed of the drive motor 38a connected to the bobbin holder 21a is decelerated at a desired gradient and is braked. During the deceleration of the drive motor 38a, the drive motor 38a returns back power to the converter section 33, i.e., the direct current section, of the inverter. The back power is detected by a detector (not shown) so as to prevent the inverter from being tripped or damaged by switching the transistor 40 so as consume the back energy in the resistance 39.

When the drive motor 38b is braked, the resistance 39 is also used to consume the back energy.

If the power is temporarily suspended, electricity stored in the condenser 36 is gradually discharged so as to continue the rotation of the drive motor 38a. The resistance 35 is disposed to allow rush current generated upon remedy of the power source gradually flow into the transistor 40 so as to prevent the transistor 40 from being damaged by the rush current.

Further, upon occurrence of temporary power suspension, the control circuit of the inverter and the relay 31 of the speed control circuit are backed up by means of a condenser or a battery in a manner similar to that described above.

According to the present embodiment, one direct current section, i.e., the converter section is disposed common to a plurality of drive motors. Accordingly, the capacity of the converter section may be sum of $I_2$ and $I_1$, which is about two third of the capacity required for a conventional apparatus. Therefore, the space for installing the winding apparatus can be small, and the cost of the winding apparatus can be inexpensive.

In a winding apparatus of bobbin changing type, rotating speeds of two motors are not decreased simultaneously. Accordingly, the capacity of the resistance, which consumes energy generated upon deceleration of the full package, can be equal to that for one drive motor. Therefore, the space for the resistance can be one half of that in a conventional apparatus, and the cost of the resistance can be decreased. Furthermore, regenerative energy generated upon braking one drive motor can be absorbed by the other drive motor. Accordingly, the capacity of the resistance can be further lessen.

It should be noted that in a conventional apparatus, the space for installing a resistance for consuming energy generated during deceleration of a package requires a space between 1 and 1.5 times of that for installing inverters connected to the drive motors. Contrary to this, according to the present embodiment, the space for installing control panel can be small.

The condenser for compensating temporary power suspension is needed to completely prevent the voltage drop from occurring for, for example, 0.06 sec. Accordingly, the condenser needs a space between 1 and 1.5 times of that for installing the inverters. Since the size of converter section can be small according to the present embodiment, the size of the condenser can be proportionally decreased to two third of that of a conventional apparatus, and the cost thereof can be inexpensive. In the above-described explanation, both the temporary suspensions of the drive motors with full bobbin and empty bobbin are compensated. However, revolving action is about only one minute among the winding operation of two or three hours, and accordingly, only the temporary power suspension of the drive motor with full bobbin may be compensated. In this case, the capacity and the cost of the condenser for compensating temporary power suspension may be almost one half of those of a conventional apparatus.

Furthermore, in the above-described embodiment, converter sections, discharging resistance, condenser for compensating temporary power suspension is disposed common to two drive motors connected to two bobbin holders, respectively. It is further possible to dispose a common power source for several yarn winding apparatuses, and converter sections, discharging resistance, condenser for compensating temporary power suspension is disposed common to the drive motors of the several yarn winding apparatuses, while their bobbin changing timing is shifted from each other.

In this case, the capacity Z of the inverter satisfies the following equation.

$$u_s I_1 + u\left(\frac{I_1 + I_2}{2}\right) \leqq Z < 2\,u\,I_2$$

In this equation:

u stands for the total number of the winding apparatuses; and $u_s$ stands for the number of the winding apparatus which are possible to be simultaneously subjected to bobbin changing operation.

Thus, the capacity and accordingly the cost can be further decreased.

What is claimed is:

1. A spindle drive type yarn winding apparatus comprising:

motor means for driving a bobbin holder;

inverter means for supplying electric power to said motor;

contact roller means for contacting with and driven by a bobbin inserted on said bobbin holder or a package wound on said bobbin;

controller means for performing at least integral control action to said motor so as to control the rotating speed of said contact roller means at a predetermined value, setter means for setting a winding speed, density of the wound package, stroke of the wound package and denier of the wound package;

first arithmetic circuit means for calculating a diameter of the wound package;

second arithmetic circuit means for calculating a gain of said controller means based on winding conditions set in said setter means and said diameter calculated in said first arithmetic circuit means; and altering means for altering the gain of said controller means based on at least one factor set in said setter means and said diameter of said wound package calculated in said first arithmetic circuit means

2. A spindle drive type yarn winding apparatus of a bobbin changing type, said winding apparatus comprising:

a plurality of drive motors connected to a plurality of bobbin holders respectively, for driving said bobbin holders;

inverter means connected to said drive motors for supplying electric power to said motors, said inverter means including a plurality of inverter sections and a converter section;

said plurality of inverter sections are disposed in parallel with each other and are connected to said plurality of drive motors, respectively;

said converter section is connected in common to said plurality of inverter sections;

the capacity of said converter section is set at at least the sum of a maximum load of one of said bobbin holders under ordinary winding conditions and a load of another one of said bobbin holders upon a start of a winding operation under ordinary winding conditions;

contact roller means for contacting with and driven by a bobbin inserted on each said bobbin holder or a package wound on said bobbin;

controller means for performing at least integral control action to said motor so as to control the rotating speed of said contact roller means at a predetermined value;

setter means for setting a winding speed, density of each wound package, stroke of each wound package and denier of each wound package;

first arithmetic circuit means for calculating a diameter of each wound package;

second arithmetic circuit means for calculating a gain of said controller means based on winding conditions set in said setter means and said diameter calculated in said first arithmetic circuit means; and altering means for altering the gain of said controller means based on at least one factor set in said setter means said diameter of said wound package calculated in said first arithmetic circuit means.

3. A spindle drive type yarn winding apparatus according to claim 2, further comprising condenser means for compensating temporary power suspension connected to said plurality of inverter sections in common.

4. A spindle drive type yarn winding apparatus according to claim 2, further comprising a regenerative resistance means connected to said plurality of inverter sections in common.

* * * * *